US007946807B2

(12) United States Patent
Philippot

(10) Patent No.: US 7,946,807 B2
(45) Date of Patent: May 24, 2011

(54) SET OF INSULATING SHEETS ON A CASING TO IMPROVE BLADE TIP CLEARANCE

(75) Inventor: Vincent Philippot, Savigny le Temple (FR)

(73) Assignee: Snecma, Paris (FR)

( * ) Notice: Subject to any disclaimer, the term of this patent is extended or adjusted under 35 U.S.C. 154(b) by 911 days.

(21) Appl. No.: 11/859,427

(22) Filed: Sep. 21, 2007

(65) Prior Publication Data

US 2008/0075584 A1 Mar. 27, 2008

(30) Foreign Application Priority Data

Sep. 22, 2006 (FR) ..... 06 53901

(51) Int. Cl.
*F01D 11/18* (2006.01)

(52) U.S. Cl. ..... 415/173.1; 415/178

(58) Field of Classification Search ..... 415/173.1
See application file for complete search history.

(56) References Cited

U.S. PATENT DOCUMENTS

| | | | | |
|---|---|---|---|---|
| 3,736,069 | A * | 5/1973 | Beam et al. | 415/178 |
| 4,317,646 | A * | 3/1982 | Steel et al. | 415/173.1 |
| 5,174,714 | A * | 12/1992 | Plemmons et al. | 415/178 |

FOREIGN PATENT DOCUMENTS

| | | | |
|---|---|---|---|
| FR | 2 293 594 | | 7/1976 |
| FR | 2 428 141 | | 1/1980 |
| FR | 2 832 178 | | 5/2003 |
| WO | WO 2005008033 | A1 * | 1/2005 |

* cited by examiner

*Primary Examiner* — Richard Edgar
(74) *Attorney, Agent, or Firm* — Oblon, Spivak, McClelland, Maier & Neustadt, L.L.P.

(57) ABSTRACT

A turbine stator of a gas turbine engine includes a turbine casing, a turbine shroud ring and a shroud ring support connecting the shroud ring to the casing. The stator is one wherein the support is provided with a heat shield positioned on the turbine side. This assembly makes it possible to reduce the take-up of play during transient operating phases.

12 Claims, 2 Drawing Sheets

SET OF INSULATING SHEETS ON A CASING TO IMPROVE BLADE TIP CLEARANCE

BACKGROUND OF THE INVENTION

The present invention relates to the field of turbine machines and is aimed at a means for controlling the clearance there is between the tips of the moving turbine blades and the casing.

A gas turbine engine conventionally comprises a compressor, in one or more stages, a combustion chamber and one or more turbine stages. The compressor, which is connected to the turbine, supplies the combustion chamber with air and the hot gases produced are directed onto the turbine in order to extract their energy. The compressor and turbine rotors have sets of blades at their periphery moving at right angles to the engine axis inside annular stator components that form shroud rings with respect to which they enjoy an operating clearance. This clearance needs to be large enough that no friction will slow the rotation of the moving parts but needs to be controlled in order to prevent a substantial amount of fluid from being diverted away from the active surfaces of the sets of blades. In order to ensure the highest possible efficiency, it is therefore important to control this clearance.

The present invention is concerned with the operating clearance of a turbine motor and more especially of the rotor positioned immediately downstream of the combustion chamber. In a multiple-spool engine, that is to say an engine comprising two or more, generally no more than three, independent shafts, this will be the high-pressure spool.

The radial clearances at the blade tips are the result of the various radial thermomechanical movements between the rotors and the stators. FIG. 1 shows an axial half section of a gas turbine engine 1, viewed in the region of the high-pressure turbine. The turbine rotor 3 comprises a disk 31, provided with blades 33 distributed around its rim, and mounted transversely on a central shaft. The rotor is positioned downstream of a nozzle guide vane stage 5 communicating with the combustion chamber 7 only the bottom of which can be seen here. The casing 9 is made up of several shell rings assembled by flanges. There is a distinction between the combustion chamber casing 91 and the high-pressure turbine casing 93. The two casings are held by a flanged assembly 95. The casing supports the elements of the combustion chamber, the upstream 5 and downstream 15 nozzle guide vanes and a support 11 for a shroud ring 13.

The radial clearance between the tips of the blades 33 and the shroud ring 11 is thus the resultant of several types of movement:

- thermal displacements resulting from the expansion of the materials as the temperature varies,
- mechanical displacements resulting from the variations in centrifugal force applied to the rotating parts, and variations in pressure.

The disks, the blades and the stator elements are subjected to both mechanical and thermal displacements.

During the various engine operating phases, because of these displacements which will not always be in the same direction, the radial clearance is not therefore constant. In particular, the rotor and the stator do not have displacements of equal amplitude, nor do they have the same thermal response time.

FIG. 2 shows the change in displacement of the rotor R and of the stator S respectively as a function of the variation in engine speed over time. Thus, it can be seen that the take-up of transient clearance A is greater than that B obtained after thermal stabilization. The take-up of clearance is to be understood to mean the magnitude of the displacement of the rotor minus that of the stator.

DESCRIPTION OF THE PRIOR ART

It is known practice to use clearance-control devices comprising ventilation means in order to control the thermal expansion of the elements of which it is made. The ventilation air is bled from the compressor at one or two points with a control in flow rate. A clearance control device such as this is incorporated in order to reduce as far as possible the clearance at the tips of the high pressure turbine blades and increase engine performance. It is generally managed by the full authority digital electronic control, often known by its English-language acronym FADEC. This means controls the temperature and the flow rate of air sent to the stator element concerned in such a way as to act on the thermal displacement thereof.

For certain engines, attempts have been made to get around these active clearance control means. The clearance at the blade tips in this case is set in such a way that the maximum blade wear during the life of the engine does not exceed the capabilities of the machine. This maximum wear is determined as a function of the maximum take-up of clearance observed during the life of the engine and is based on the displacements of the stator and of the rotor. This maximum take-up is generally observed during cycles known in the art as critical reburst. A cycle such as this consists, from a stabilized full throttle operating speed, in reducing the speed to low idle in a short space of time then instigating a reacceleration up to full throttle, again in a short space of time.

During this cycle, the take-up of clearance is great for the following reasons:

- since the rotor is stabilized at full throttle, the displacements due to thermal expansion of the disk are slow when the rapid variation in operating speed toward low idle is commanded because of the significant mass of this rotor and the ensuing lengthy thermal response time;
- the stator elements, which also were stabilized at full throttle speed have a smaller mass and therefore a more rapid thermal response.

On immediately reaccelerating to full throttle operating speed, the rotor has not yet become thermally stabilized at low idle because of its long thermal response time. By contrast, the stator will have already reached the low idle operating conditions. It therefore follows that, at this moment, there is a take-up of play and the blade tip clearance is small.

Because of the acceleration, the disk experiences a centrifugal displacement leading to a temporary additional take-up of play. This additional take-up of play results in part wear because the blade tips come into contact with the shroud ring.

It can therefore be seen that the more rapid the thermal response of the casing with respect to that of the rotor, the more take-up of clearance there is, and the greater the blade tip wear during reacceleration.

SUMMARY OF THE INVENTION

It is a first objective of the invention to find a solution to this problem.

Another objective is to find a solution which does not involve significant modifications to the existing structure and which is inexpensive to implement.

According to the invention, the turbine stator of a gas turbine engine comprising a turbine casing, a turbine shroud ring and a shroud ring support connecting the shroud ring to the casing is one wherein the support is provided with an element that forms a heat shield positioned on the turbine side.

The solution therefore consists in increasing the thermal response time of the stator by using a heat shield which delays the influence of the temperature of hot gases in the stream from the combustion chamber. This solution is highly advantageous because it has proven to be effective. Furthermore, it can be implemented using relatively simple means.

Thus, according to another feature, the element forming a heat shield comprises a sheet forming a space with respect to the support surface. As a preference, the space forms a dead cavity not swept by gases. According to another embodiment, the space contains a thermally insulating material.

The invention applies more particularly to a stator the support of which comprises, on one side, a radial flange for securing to the turbine casing and, on the other side, a means for securing the elements of the shroud ring. The support advantageously forms a partition wall of frustoconical overall shape and the means for securing the elements of the shroud ring comprise two radial flanges sandwiching the elements of the shroud ring.

According to one particular embodiment, the element forming a heat shield comprises a first sheet fixed between two radial flanges. It also comprises a second sheet positioned axially between the means for securing the elements of the shroud ring and the radial flange for fixing the support to the casing.

BRIEF DESCRIPTION OF THE DRAWINGS

The invention will now be described with reference to a nonlimiting embodiment based on the attached drawings in which.

DESCRIPTION OF THE PREFERRED EMBODIMENT

Figure 1:
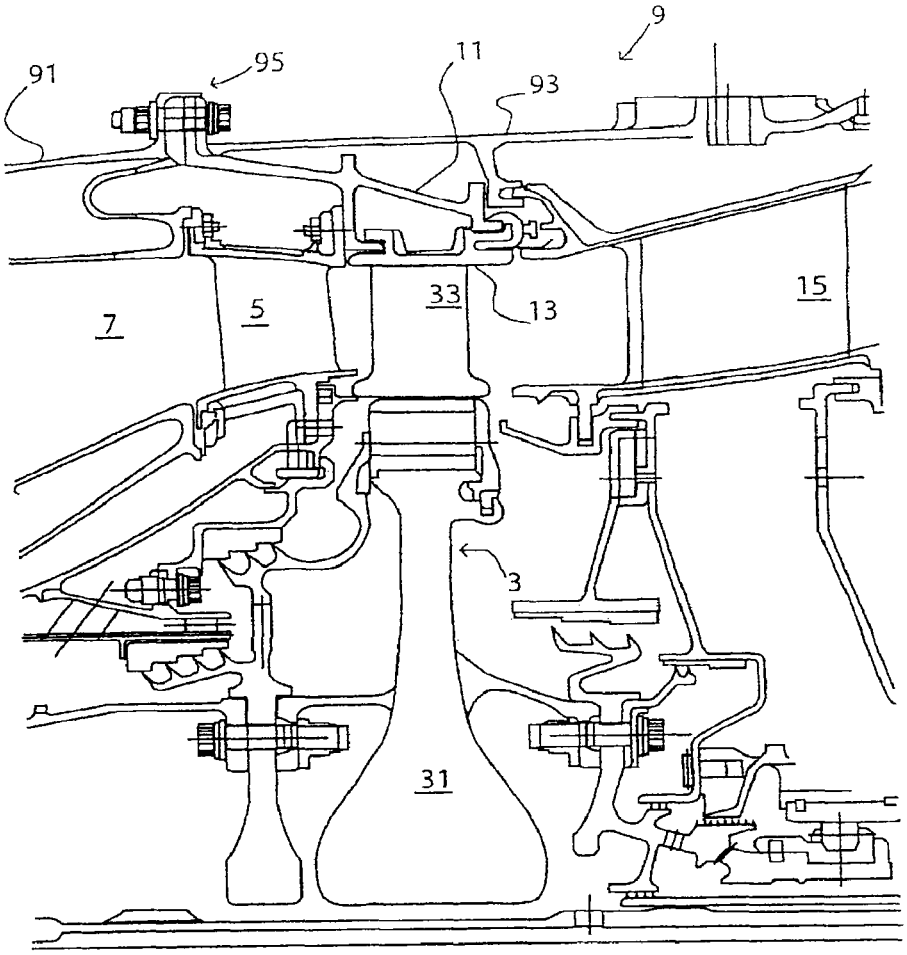
FIG. 1 shows an axial half section of one example of part of a gas turbine engine in the region of the high-pressure turbine immediately downstream of the combustion chamber.
Figure 2:
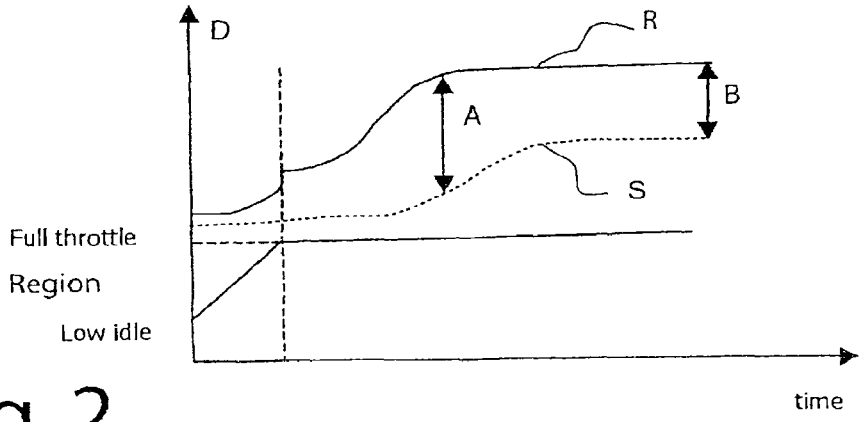
FIG. 2 shows the displacement D of, respectively, the rotor blade tips and the stator elements that form the operating clearance.
Figure 3:
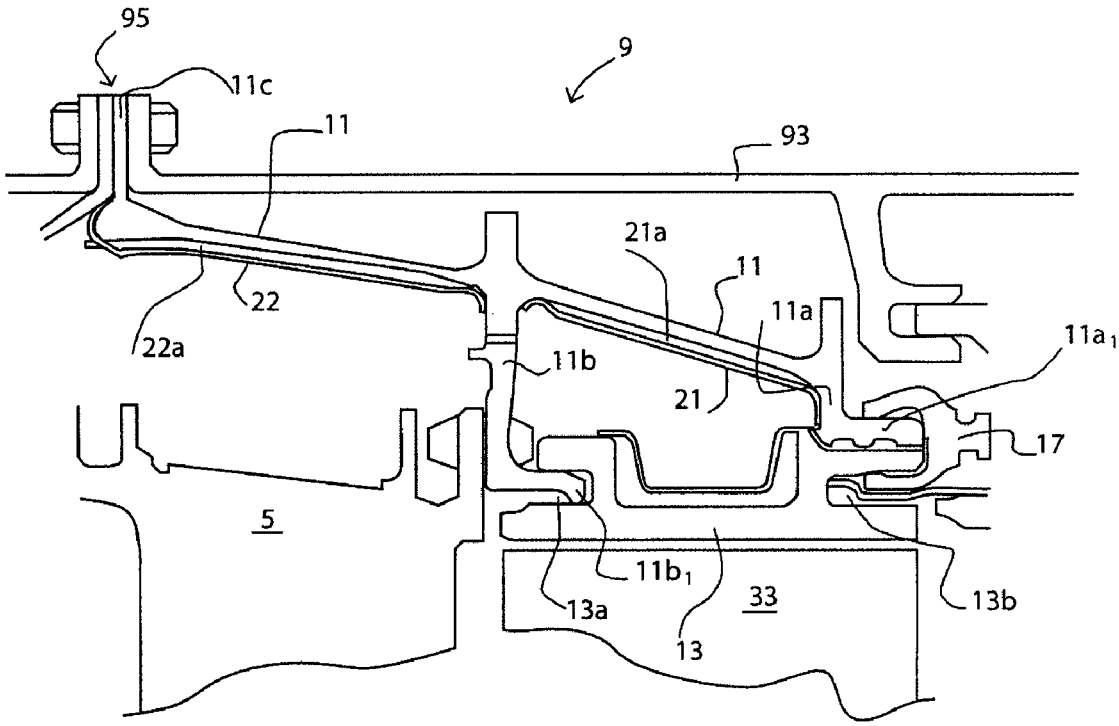
FIG. 3 shows in greater detail and in an enlarged view that part of the turbine casing that is provided with an element that forms a heat shield.

FIG. 3 shows an enlarged detail of the mounting of the shroud ring 13 in the casing 9, incorporating the solution of the invention. The ring support 11 according to the example consists of a metal partition wall, such as an annular partition wall, of substantially frustoconical shape with the same axis as the engine. The support here is formed as a single piece but could equally consist of several ring sectors joined together to form an annular entity. The support 11 comprises radial flanges 11*a* and 11*b* for attaching the elements 13 that form the high-pressure or HP turbine shroud ring. Attachment according to this example is of the tongue and groove type. For the upstream fixing, towards the combustion chamber, the back of the elements 13 is shaped to form an axially opening groove 13*a* which collaborates with an axial return 11*b*1 of the radial flange 11*b*. The downstream fixing of the elements 13 is provided also by a groove 13*b* the external branch of which bears against an axial return 11*a*1 of the flange 11*a* and is held in position by clamps 17.

The upstream nozzle guide vanes 5 are fixed by bolts to the radial flange 11*b*.

The support 11 is itself mounted on the turbine casing 93 via a radial transverse flange 11*c*. This flange is inserted in the flange assembly 95 which connects the various elements of the casing 9. The support 11 does not have any active clearance control nor does it have any ventilation means for achieving this.

According to the invention, a heat shield has been positioned on the internal face of the support 11, that is to say on the face facing into the engine gas stream. The heat shield advantageously consists of a first sheet positioned parallel to the support wall 11 between the two radial flanges 11*a* and 11*b*. This sheet is secured by welding, brazing, screw-fastening or any other fastening means, to the support. The sheet 21 is distant from the partition wall 11 so as to form a cavity 21*a*. This cavity is preferably dead, that is to say that the gases it contains do not circulate. It is, for example, a closed cavity. The cushion of gas thus forms a thermally insulating mass. However, if appropriate, this cavity may contain another thermally insulating material. A second sheet is positioned in the same way, upstream of the flange 11*b*, on the internal face of the partition wall 11 some distance therefrom. It is welded, brazed, screw-fastened or the like to the partition wall and forms a dead cavity 22*a* with the partition wall 11. The mass of gas contained in this dead cavity thus forms a thermally insulating layer.

The support 11 is made of metal as are the sheets 21 and 22. In stabilized speed operation, the clearance between the blade tip 33 and the ring 13 is fixed and of a determined value. This clearance is the result of equilibrium between deformations of mechanical and thermal origin to which the moving and stationary parts are subjected. In transient conditions this equilibrium is upset. Particularly in the case of critical reburst, as explained above, during the phase of rapid reduction in speed, the temperature of the gases in the driving stream drops. Because of the heat shield, the response to the drop in temperature of the support is slowed by comparison with that of the setup of the prior art. This means that during the sudden reacceleration or reburst that follows, the radial displacement of the rotor as a result of the increase in centrifugal forces does not interfere with the elements of the shroud ring. There is no contact between the blade tips and the elements of the shroud rings. No wearing either of the blade tip rub strips or of the abradable surfaces of the elements is observed.

The results of testing have demonstrated that the solution is effective and that the machine efficiency is improved as a consequence. Furthermore, attaching sheets is not particularly expensive. Overall, the solution is effective and economical.

The invention claimed is:

1. A turbine stator of a gas turbine engine comprising:

a turbine casing, a turbine shroud ring, and a shroud ring support connecting the shroud ring to the casing, wherein the shroud ring support is provided with a heat shield positioned on a turbine side of said shroud ring support, wherein said heat shield is positioned and configured to control a thermal response of said shroud ring support thereby controlling a clearance between said turbine shroud ring and turbine blades configured to rotate inside said turbine shroud ring, wherein said shroud ring support comprises a radial flange on just one side, said shroud ring support being fixed to the turbine casing via said radial flange, and wherein said shroud ring support is free of any ventilation clearance control device for controlling said clearance between said turbine shroud ring and said turbine blades.

2. The stator as claimed in claim 1, wherein the heat shield comprises a sheet forming a space with respect to a surface of said shroud ring support.

3. The stator as claimed in claim 2, wherein the space forms a dead cavity not swept by gases.

4. The stator as claimed in claim 2, wherein said space contains a thermally insulating material.

5. The stator as claimed in claim 1, wherein the shroud ring support comprises, on a side opposite said radial flange, means for securing elements of the turbine shroud ring.

6. The stator as claimed in claim 5, wherein the shroud ring support is in the form of a frustoconical partition wall.

7. The stator as claimed in claim 5, wherein the means for securing the elements of the shroud ring comprise two radial flanges sandwiching the elements of the turbine shroud ring.

8. The stator as claimed in claim 7, wherein the heat shield comprises a first sheet fixed between two radial flanges.

9. The stator as claimed in claim 8, wherein the heat shield comprises a second sheet positioned axially between the means for securing the elements of the turbine shroud ring and the radial flange for fixing the support to the casing.

10. A turbine engine comprising a turbine stator as claimed in claim 1 and said turbine blades configured to rotate inside said stator.

11. A turbine engine as claimed in claim 10, further comprising nozzle guide vanes fixed to said shroud ring support via an intermediate radial flange of said shroud ring support, said nozzle guide vanes being upstream from said turbine blades, and wherein said heat shield comprises an upstream metal sheet radially positioned between said shroud ring support and said nozzle guide vanes.

12. A turbine engine as claimed in claim 10, wherein said heat shield further comprises a downstream metal sheet radially positioned between said shroud ring support and said turbine blades, said upstream and downstream metal sheets being separated by said intermediate radial flange.

* * * * *